US009808703B2

(12) United States Patent
Kadish et al.

(10) Patent No.: US 9,808,703 B2
(45) Date of Patent: Nov. 7, 2017

(54) FLEXIBLE PROTECTIVE SPORTS BOARD SLEEVE

(71) Applicants: Aram Kadish, Santa Monica, CA (US); Alan Kadish, Cornvallis, OR (US)

(72) Inventors: Aram Kadish, Santa Monica, CA (US); Alan Kadish, Cornvallis, OR (US)

( * ) Notice: Subject to any disclaimer, the term of this patent is extended or adjusted under 35 U.S.C. 154(b) by 0 days.

(21) Appl. No.: 14/731,920

(22) Filed: Jun. 5, 2015

(65) Prior Publication Data

US 2015/0360118 A1 Dec. 17, 2015

Related U.S. Application Data

(60) Provisional application No. 62/012,915, filed on Jun. 16, 2014.

(51) Int. Cl.
*A63C 11/02* (2006.01)
*B63B 35/79* (2006.01)

(52) U.S. Cl.
CPC ..... *A63C 11/027* (2013.01); *B63B 35/7946* (2013.01)

(58) Field of Classification Search
CPC .... B65D 65/04; B65D 65/08; B63B 35/7946; A63C 11/027
USPC ..... 206/315.1; 150/154; 280/809; 40/360
See application file for complete search history.

(56) References Cited

U.S. PATENT DOCUMENTS 3,339,607 A * 9/1967 Howard ..... B63B 35/7946 114/79 R
4,191,233 A * 3/1980 McKay ..... A63C 11/027 206/315.1
4,196,762 A * 4/1980 Goodwin ..... A63C 11/027 206/315.1
4,993,549 A * 2/1991 Diard ..... A63C 11/027 206/315.1
5,033,497 A * 7/1991 Hernandez ..... E04H 15/30 135/116
5,147,235 A * 9/1992 Bamburak ..... B63B 35/7946 114/361
2005/0023177 A1* 2/2005 Kiger ..... B63B 35/7946 206/522
2007/0123371 A1* 5/2007 Liberatore ..... A63B 15/00 473/457

(Continued)

FOREIGN PATENT DOCUMENTS

DE 2109817 A1 * 9/1972 ..... A63C 11/027

*Primary Examiner* — Sue A Weaver
(74) *Attorney, Agent, or Firm* — TJSL Patent Clinic; Bridget Madden; John David Cowart

(57) ABSTRACT

A flexible, reusable protective sports board sleeve for use inside of a sports board bag comprises a first panel and a second panel. The first panel is joined to the second panel along the respective outer edges of the panels thereby creating an overlapping pocket, wherein the overlapping pocket receives a sports board through the sleeve's tip end, and the bottom edge of the sports board sleeve allows attachment to the tail end of the sports board. The sleeve is made of a flexible, wax-resistant material that allows the sports board to easily slide in and out of a sports board bag without wax sticking to the inside of the sports board bag. There are both horizontal and parallel longitudinal lines printed on the sleeve to help users customize the dimensions of said sleeve by cutting along the horizontal and parallel longitudinal lines.

7 Claims, 3 Drawing Sheets

(56) References Cited

U.S. PATENT DOCUMENTS

| | | | | |
|---|---|---|---|---|
| 2009/0235427 | A1* | 9/2009 | Suzuoki | A41D 15/002 2/115 |
| 2010/0006469 | A1* | 1/2010 | Allouche | B63B 35/7946 206/523 |
| 2012/0006454 | A1* | 1/2012 | Jenkins | B63B 35/7933 150/154 |
| 2012/0118766 | A1* | 5/2012 | Baker | B63B 35/7946 206/315.1 |
| 2012/0234706 | A1* | 9/2012 | Underfer | A63C 11/025 206/278 |

* cited by examiner

FLEXIBLE PROTECTIVE SPORTS BOARD SLEEVE

CROSS-REFERENCE TO RELATED APPLICATION

The present application claims priority to U.S. Provisional Patent Application No. 62/012,915 filed on Jun. 16, 2014, entitled "FLEXIBLE PROTECTIVE SPORTS BOARD SLEEVE" the entire disclosure of which is incorporated by reference herein. No new matter has been introduced.

FIELD OF THE INVENTION

The present disclosure is directed to protective covers, and more specifically to flexible, light-weight sports board sleeves that have a wax-resistant interior to provide protection for both the sports boards and the accompanying bags.

BACKGROUND OF THE DISCLOSURE

Many sports board users use board bags to protect their boards. Typically, users apply wax to the surface of the sports boards to improve traction between the body and the board. Furthermore, this wax melts due to its particular properties, causing difficulties to remove the boards out of their traditional bags. Moreover, the melted wax creates heavy, inflexible board bags that are difficult to use over time.

It is desirable to have a flexible, lightweight sports board sleeve that allows users to insert or remove waxed boards from the bag without disturbing the wax so that the bag can be re-used multiple times. In addition, the board bag dimensions should be customizable to accommodate boards of different sizes. Others have attempted to provide pseudo sports board bags, either by using elastic edges so that the respective bag does not cover the waxed portion of the board or by applying removable sheets to the interior of the bag. Moreover, others have just provided bags with interiors that are more easily washable. Although such designs and complements help prevent wax from transferring onto the bag, they either allow parts of the sports board to be exposed and thus unprotected, or are just difficult to use because the user must either wash them or replace them.

The aforementioned arrangements suffer from disadvantages that the present disclosure seeks to resolve.

SUMMARY

The present disclosure provides a lightweight protective sports board sleeve that is both wax-resistant and flexible. In an exemplary embodiment, the present disclosure provides a flexible protective sports board sleeve, comprising a top panel; and a bottom panel, wherein said bottom panel is joined to said top panel along the respective outer edges of said panels thereby creating an overlapping pocket, wherein said overlapping pocket receives a sports board through said board's tip, and wherein the bottom edge of said sleeve is attached to the tail end of said sports board with a hook and loop tape.

In an exemplary embodiment, the overlapping pocket remains intact relative to the width of the edges of said panels after said sleeve is cut to the desired dimensions.

In yet another exemplary embodiment, the sports board sleeve comprises a flexible sheet.

In still another exemplary embodiment, the overlapping pocket is about 12 inches long and about 16 to 24 inches wide.

In further exemplary embodiment, a plurality of longitudinal latitudinal lines are printed on the sports board sleeve and said latitudinal lines indicate 9 foot, 8 foot, 7 foot and 6 foot lengths.

In another exemplary embodiment, a plurality of parallel longitudinal lines are printed on the sports board sleeve and said parallel longitudinal lines indicate 22 inches, 20 inches, 18 inches and 16 inches in width.

In yet another exemplary embodiment, the sports board sleeve is about 24 inches wide and about 10 feet long.

In still another exemplary embodiment, the sports board sleeve comprises plastic.

BRIEF DESCRIPTION OF THE DRAWINGS

The foregoing features and advantages of the present disclosure can be appreciated more fully from the following description, with reference to the accompanying drawings.

DETAILED DESCRIPTION

Figure 1:
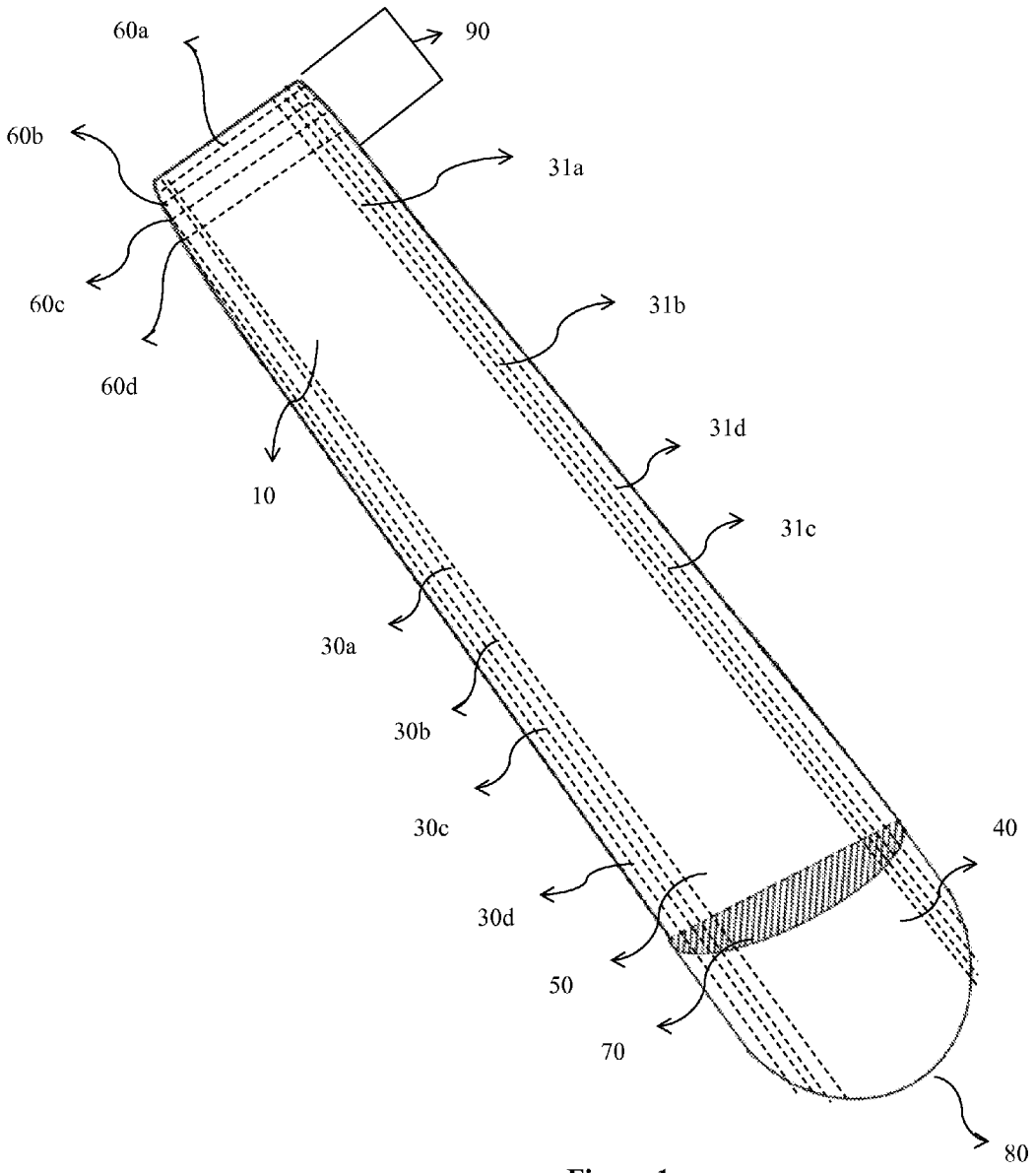
FIG. 1 illustrates an isometric view of an exemplary sports board sleeve according to an exemplary embodiment of the present disclosure.

The following detailed description is directed to certain exemplary embodiments. However, the present disclosure can also be further embodied in a multitude of different ways as defined and covered by the claims and equivalents thereof. In this description, reference is made to the drawings wherein like parts are designated with like reference numerals throughout.

As used in the description herein and throughout this disclosure, the meaning of "a," "an," and "the" includes plural reference unless the context clearly dictates otherwise. Also, as used in the description herein, the meaning of "in" includes "into" and "on" unless the context clearly dictates otherwise.

As shown in FIG. 1, in an exemplary embodiment, a sports board sleeve 10 comprises a top panel 50, a bottom panel 40, tip 80, a hook and loop tape (not shown), a plurality of parallel latitudinal lines 60*a*, 60*b*, 60*c*, and 60*d*, and a plurality of parallel longitudinal lines 30*a*, 30*b*, 30*c*, and 30*d*. In an exemplary embodiment, top panel 50 comprises a flexible sheet. In an exemplary embodiment, the flexible sheet comprises plastic. Top panel 50 and bottom panel 40 are joined along their respective outer edges, thereby creating an overlapping pocket 70. In an exemplary embodiment, overlapping pocket 70 may receive a sports board (not shown) through the tip of sports board sleeve 10, such that bottom panel 40 covers the entire length of a sports board and top panel 50 covers the top portion of sports board. In an exemplary embodiment, overlapping pocket 70 is about 12 inches long, but the overlapping pocket may vary in length depending on the application. In an exemplary embodiment, sports board sleeve 10 is flexible and lightweight to allow users to insert or remove waxed sports board (not shown) from sports board sleeve 10 without disturbing the wax so that sports board sleeve 10 may be re-used multiple times.

In an exemplary embodiment, the dimensions for the hook and loop tape (not shown) range from about 1 inch wide by 1 inch long to about 2 inches wide to 2 inches long, but the dimensions may vary depending on the application. In an exemplary embodiment, the female portion of said hook and loop tape (not shown) is a square tab that may be attached to the tail end of a sports board. Further the female portion attaches to the male portion of the tape, which may be attached to the middle section of sports board sleeve 10 that corresponds with the center line of the sports board located on the rear portion of the sports board's tail. In an exemplary embodiment, the center line is located on the rear 2 to 4 inches of the sports board's tail.

In an exemplary embodiment, sports board sleeve 10 is about 24 inches wide and about 10 feet long. A person of an ordinary skill in the art would appreciate that the size of sports sleeve may vary according to the size of the sports board and thus sports board sleeve 10 may be customized to accommodate the user's needs.

In an exemplary embodiment, top panel 50 comprises a plurality of parallel latitudinal lines (first latitudinal line 60*a*, second latitudinal line 60*b*, third latitudinal line 60*c*, and fourth latitudinal line 60*d*), that correspond with different lengths for various sports boards. In one exemplary embodiment, the distance between tip 80 of sports board sleeve 10 and first latitudinal line 60*a* is about 9 feet, but this distance may vary depending on the size of the sleeve. Exemplary embodiments could be different sizes to accommodate sports boards of varying size. In an exemplary embodiment, the distance between tip 80 of sports board sleeve 10 and second latitudinal line 60*b* is about 8 feet, but this distance may vary depending on the size of the sleeve. Exemplary embodiments could be different sizes to accommodate sports boards of varying size. In an exemplary embodiment, the distance between tip 80 of the sports board sleeve 10 and third latitudinal line 60*c* is about 7 feet, but this distance may vary depending on the size of the sleeve. Exemplary embodiments could be different sizes to accommodate sports boards of varying size. In another exemplary embodiment, the distance between tip 80 of sports board sleeve 10 and fourth latitudinal line 60*d* is about 6 feet, but this distance may vary depending on the size of the sleeve. Exemplary embodiments could be different sizes to accommodate sports boards of varying size. In yet another exemplary embodiment, when the user of the sports board sleeve 10 cuts along the appropriate latitudinal line corresponding to the dimensions of his/her sports board, then the hook and loop tape (not shown) is attached to the inner bottom edge 90 of the sports board sleeve 10 to secure it to a sports board.

In another exemplary embodiment, top panel 50 further comprises parallel vertical lines 30*a*, 30*b*, 30*c*, 30*d*, 31*a*, 31*b*, 31*c*, and 31*d* that correspond with different widths for various sports boards. In an exemplary embodiment, the user of the sports board sleeve 10 cuts along the appropriate parallel longitudinal line corresponding to the dimensions of his/her sports board to fit the user's sports board. In one exemplary embodiment, the distance between parallel longitudinal lines 30*a* and 31*a* is about 16 inches, but this distance may vary depending on the size of the sleeve. Exemplary embodiments could be different sizes to accommodate sports boards of varying size. In another exemplary embodiment, the distance between parallel longitudinal lines 30*b* and 31*b* is about 18 inches but this distance may vary depending on the size of the sleeve. Exemplary embodiments could be different sizes to accommodate sports boards of varying size. In yet another exemplary embodiment, the distance between parallel longitudinal lines 30*c* and 31*c* is about 20 inches but this distance may vary depending on the size of the sleeve. Exemplary embodiments could be different sizes to accommodate sports boards of varying size. In still another embodiment, the distance between parallel longitudinal lines 30*d* and 31*d* is about 22 inches but this distance may vary depending on the size of the sleeve. Exemplary embodiments could be different sizes to accommodate sports boards of varying size.

In an exemplary embodiment, if the sports board 100 is about 8 feet long and about 16 inches wide, the user cuts the sleeve 10 along the latitudinal line 60*b* and along the longitudinal lines 31*a* to 30*a* to customize his/her sports board (not shown). In an exemplary embodiment, overlapping pocket 70 remains intact relative to the width of the edges of both top and bottom panels 50 and 40, respectively after sports board sleeve 10 is cut to the desired dimensions.

Figure 2A:
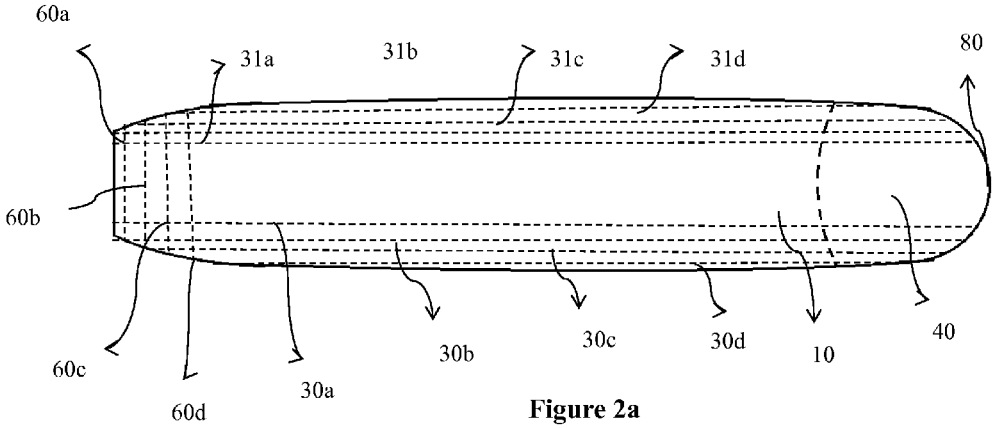
FIG. 2*a* illustrates a bottom view of an exemplary long sports board sleeve according to an exemplary embodiment of the present disclosure.
Figure 2B:
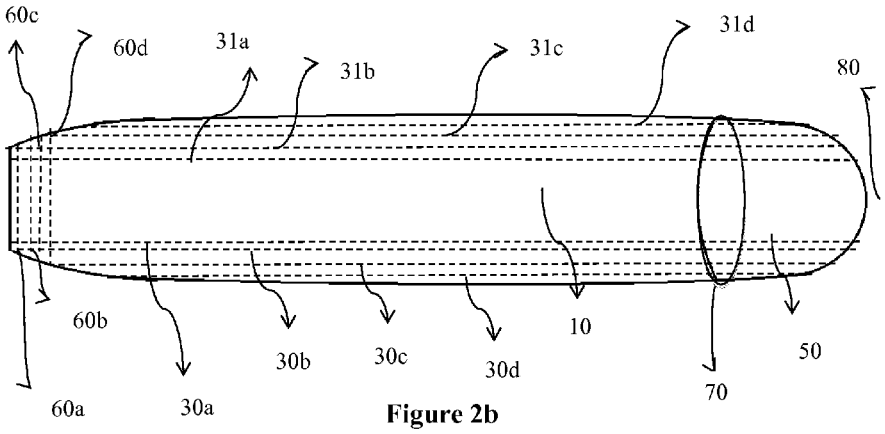
FIG. 2*b* illustrates a top view of an exemplary long sports board sleeve according to an exemplary embodiment of the present disclosure.

In another exemplary embodiment, as shown in FIG. 2*a*, the present disclosure is directed to a sports board sleeve 10 that protects a long sports board (not shown). Once the user trims the sports board sleeve 10 along the corresponding latitudinal lines (60*a*, 60*b*, 60*c*, or 60*d*) and longitudinal lines (30*a*, 30*b*, 30*c*, 30*d*, 31*a*, 31*b*, 31*c*, and 31*d*) to the corresponding desired dimensions, then the hook and loop tape (not shown) is used to attach sports board sleeve 10 to the sports board. In one exemplary embodiment, the dimensions of the sports board sleeve 10 for a long sports board range from about 20 to 24 inches wide and from about 8 to 10 feet long. But the dimensions of the sports board sleeve may vary depending on the sports board size. In another exemplary embodiment, as shown in FIG. 2*b*, the bottom view of the sports board sleeve shows the overlapping pocket 70 formed when bottom panel 40 and top panel 50 are connected together. In an exemplary embodiment, top and bottom panels 50 and 40 are molded or glued together along their respective outer edges.

Figure 3A:
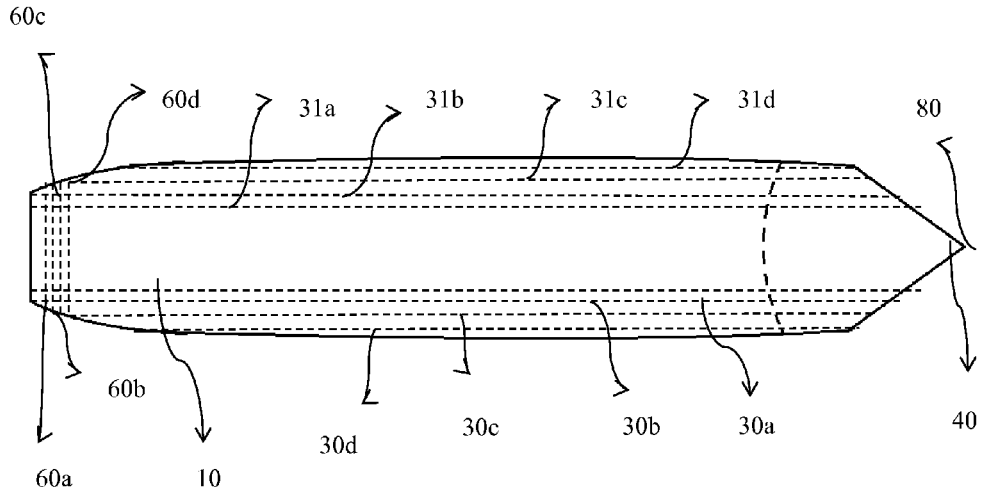
FIG. 3*a* illustrates a bottom view of an exemplary short sports board sleeve according to an exemplary embodiment of the present disclosure.
Figure 3B:
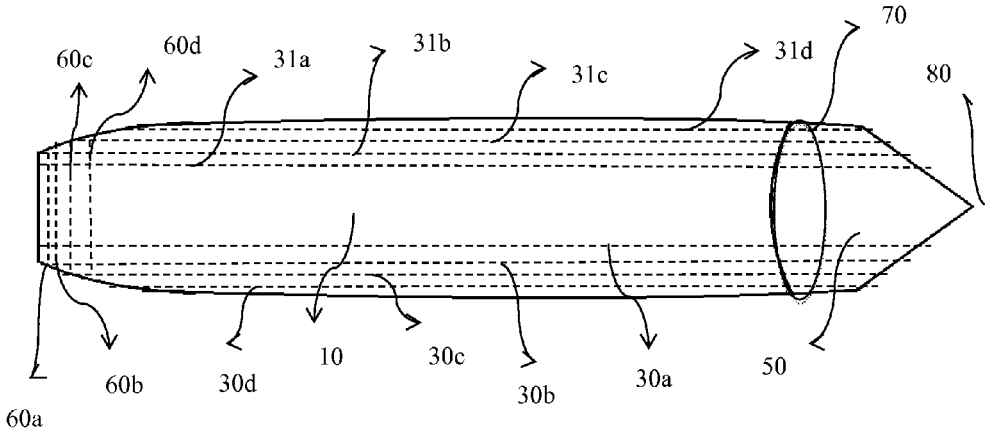
FIG. 3*b* illustrates a top view of an exemplary short sports board sleeve according to an exemplary embodiment of the present disclosure.

In another exemplary embodiment, as shown in FIG. 3*a*, the present disclosure is directed to a sports board sleeve 10 that protects a short sports board (not shown). Once the user trims the sports board sleeve 10 along the latitudinal lines (60*a*, 60*b*, 60*c*, or 60*d*) and longitudinal lines (30*a*, 30*b*, 30*c*, 30*d*, 31*a*, 31*b*, 31*c*, and 31*d*) to the corresponding desired dimensions, then the hook and loop tape (not shown) is used to attach the sports board sleeve 10 to the sports board. In an exemplary embodiment, the dimensions of the sports board sleeve 10 for a short sports board is about 14 to 20 inches wide and about 5 to 7 feet inches long. But the dimensions of the sports board sleeve may vary depending on the board size. A shown in FIG. 3*b*, the bottom view of the sports board sleeve 10 shows the overlapping pocket 70 formed when the bottom panel 40 and top panel 50 are molded or glued along their respective outer edges.

In an exemplary embodiment, as the width of the sports board sleeve 10 is reduced to correspond to the desired width of the sports board, the overall length of the overlapping pocket 70 remains constant, so that the length of the overlapping pocket 70 is about 12 inches long. However, the overlapping pocket may vary in length depending on the application.

A person of ordinary skill in the art would readily understand that variations in sports boards' dimensions and customization, both for short and long sports boards do not detract from using the sports board sleeve of the present disclosure. The latitudinal and longitudinal lines provided according to the disclosure readily accommodate such variations in dimensions of any types of sports board whether customized or commercially available.

Thus, exemplary embodiments of a flexible protective sports board sleeve have been disclosed. It should be apparent, however, to those skilled in the art that many more modifications besides those already described are possible without departing from the disclosure concepts herein. The disclosed subject matter, therefore, is not to be restricted in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referred elements, components, or steps may be present, utilized, or combined with other elements, components, or steps that are not expressly referenced. Furthermore, when a definition or use of a term in a reference, which is incorporated by reference herein, is inconsistent or contrary to the definition of that term provided herein, the definition of that term provided herein applies and the definition of that term in the reference does not apply.

The invention claimed is:

1. A protective sports board sleeve constructed to provide protection against contact between a sports board and a sports board bag into which the sports board is inserted, the sports board sleeve comprising:

a first panel formed of a flexible material and sized for application across substantially the entire area of a surface of the sports board; and a second panel coupled with the first panel to form a pocket positioned at a tip end of the sleeve to receive the sports board.

2. The sleeve according to claim 1, wherein the flexible material has physical characteristics that prevent a sticky substance from transferring from the sports board to the sports board bag.

3. The sleeve according to claim 1, wherein the flexible material has physical characteristics that prevent a wax-based substance from transferring from the sports board to the sports board bag.

4. The sleeve according to claim 1, wherein the flexible material comprises plastic.

5. The sleeve according to claim 1, wherein the first panel bears one or more lines to serve as guides for customizing the size of the sleeve to the board.

6. The sleeve according to claim 1, wherein the first panel is constructed to allow attachment of a tail end of the first panel to the sports board.

7. The sleeve according to claim 1, wherein the second panel is approximately 12 inches in length such that the pocket overlaps the sports board by approximately 12 inches.

* * * * *